US011802362B2

(12) United States Patent
Cinello et al.

(10) Patent No.: US 11,802,362 B2
(45) Date of Patent: Oct. 31, 2023

(54) LAUNDRY APPLIANCE WITH IMPROVED DRAWER

(71) Applicant: Electrolux Appliances Aktiebolag, Stockholm (SE)

(72) Inventors: Mauro Cinello, Porcia (IT); Daniele Da Riol, Porcia (IT)

(73) Assignee: Electrolux Appliances Aktiebolag

( * ) Notice: Subject to any disclaimer, the term of this patent is extended or adjusted under 35 U.S.C. 154(b) by 262 days.

(21) Appl. No.: 17/268,791

(22) PCT Filed: Aug. 23, 2019

(86) PCT No.: PCT/EP2019/072623
§ 371 (c)(1),
(2) Date: Feb. 16, 2021

(87) PCT Pub. No.: WO2020/043627
PCT Pub. Date: Mar. 5, 2020

(65) Prior Publication Data

US 2021/0355623 A1 Nov. 18, 2021

(30) Foreign Application Priority Data

Aug. 30, 2018 (EP) ..... 18191667

(51) Int. Cl.
*D06F 39/02* (2006.01)

(52) U.S. Cl.
CPC ..... *D06F 39/02* (2013.01)

(58) Field of Classification Search
CPC ..... D06F 39/02
See application file for complete search history.

(56) References Cited

U.S. PATENT DOCUMENTS

2009/0322195 A1* 12/2009 Joerger ..... D06F 39/02 312/334.1

FOREIGN PATENT DOCUMENTS

| | | | |
|---|---|---|---|
| DE | 102010002532 | A1 | 9/2011 |
| EP | 0959171 | A1 | 11/1999 |
| EP | 1842953 | A2 | 10/2007 |
| EP | 2784205 | A1 | 10/2014 |
| EP | 3272930 | A1 | 1/2018 |
| KR | 101215448 | B1 | 12/2012 |

OTHER PUBLICATIONS

European Communication under Rule 71(3) for European Application No. 18191667.6, dated Apr. 26, 2021, 36 pages.
International Search Report and Written Opinion for International Applicalion No. PCT/EP2019/072623, dated Oct. 17, 2019, 9 pages.

* cited by examiner

*Primary Examiner* — Jason Y Ko
(74) *Attorney, Agent, or Firm* — RatnerPrestia

(57) ABSTRACT

A laundry appliance having a cabinet accommodating a laundry treatment chamber, a storage drawer comprising at least one compartment adapted to contain multiple doses of a respective laundry treatment agent for performing multiple washing cycles, and a drawer seat provided in the cabinet for slidingly housing the storage drawer through a guide system. The guide system is adapted to guide the sliding of the storage drawer with respect to the drawer seat along a sliding direction which is slanted with respect to a resting surface on which the laundry appliance is resting during operation.

19 Claims, 10 Drawing Sheets

LAUNDRY APPLIANCE WITH IMPROVED DRAWER

This application is a U.S. National Phase application of PCT International Application No. PCT/EP2019/072623, filed Aug. 23, 2019, which claims the benefit of European Application No. 18191667.7, filed Aug. 30, 2018, both of which are incorporated by reference herein.

BACKGROUND OF THE PRESENT INVENTION

Field of the Present Invention

The present invention generally relates to the field of laundry treatment appliances (hereinafter, concisely, "laundry appliances"), and particularly to laundry appliances for treating, e.g. washing, items (such as linen, clothes, garments, shoes, and the like), such as laundry washing machines and combined laundry washing and drying machines. More particularly, the present invention relates to a laundry appliance having an improved drawer.

Overview of the Related Art

As it is well known, laundry appliances comprise a laundry treatment chamber wherein items to be treated (e.g., washed, rinsed and additionally dried) are placed to be subjected to various laundry treatment operations.

Making reference to a laundry washing machine (but similar considerations also apply to combined laundry washing and drying machines), such laundry treatment operations involve the use of detergent substances, in powder and/or in liquid form, and of possible additional substances, such as for example softening agents, and rinsing agents, which will be defined in the present description as a whole as "laundry treatment agents".

During some phases of laundry treatment operations, amounts of such laundry treatment agents should be delivered into the laundry treatment chamber in a controlled way. For this purpose, the laundry washing machine is equipped with a laundry treatment agents dispensing system comprising one or more laundry treatment agent containers adapted to be loaded with amounts of laundry treatment agents, and delivery devices for delivering into the laundry treatment chamber controlled amounts of the laundry treatment agents contained in the laundry treatment agent containers.

Making reference to a front-loading washing machine, the laundry treatment agent containers of the dispensing system are usually implemented as compartments of a drawer, which can be (at least partially) extracted from a front portion of the washing machine cabinet. Typically, the drawer is slidingly housed in a drawer seat through a guide system providing for guide elements located on the drawer which slidingly engage guide elements located on the drawer seat.

As it is well known to those skilled in the art, the compartments of the drawer can be configured to be loaded by a user with single, individual doses of laundry treatment agents, e.g., with an amount of laundry treatment agent necessary for a laundry treatment cycle on a single load of items, or may have a larger capacity sufficient to store more doses of laundry treatment agents, adapted to be used for more laundry treatment cycles on a plurality of loads of items.

SUMMARY OF THE PRESENT INVENTION

Applicant has observed that currently available drawers having compartments configured to store multiple doses of laundry treatment agent are generally affected by some drawbacks The guide systems for drawers equipped with compartments adapted to store multiple doses of laundry treatment agent are in general subjected to greater mechanical stresses compared to the ones for drawers which are only equipped with compartments configured to be loaded with single doses, because of the higher weight due to the higher amount of laundry treatment agent.

The weight of a drawer having compartments fully (or at least substantially fully) loaded with multiple doses of laundry treatment agent may be such to dramatically impair the mechanical stability of the drawer itself when the latter is partially extracted from the drawer seat. Indeed, if the weight is too high, once partially extracted from the drawer seat, the drawer may bend itself downwardly under the action of gravity. This is an inconvenient situation, because it may cause some amount of laundry treatment agent to spill out from the compartments and, if the weight is particularly great, the guide elements could wear down or even break up.

Moreover, if the drawer happens to be downwardly bent because of the weight, it may disadvantageously touch a part of the door of the laundry appliance, preventing (or at least obstructing) the free opening/closing movement of such door, and/or damaging aesthetical parts of the door.

Another drawback affecting drawers of this kind regards the undesired spilling of laundry treatment agent stored in the compartments which may occur when the drawer is sliding inside/outside the drawer seat. Indeed, the accelerations the drawer is subjected to during the sliding movement may cause the generation of waves on the free surface of the laundry treatment agent contained in the compartments, especially in the compartments loaded with a plurality of doses of laundry treatment agents. If the stored amount of laundry treatment agent and/or the acceleration is/are particularly high, the height of the waves may be so high to cause spilling of laundry treatment agent outside the drawer.

In view of the above, it is an object of the present invention to provide a laundry appliance able to overcome these, as well as other, drawbacks, and particularly it is an object of the present invention to provide a laundry appliance featuring an improved drawer whose guide system is less subjected to wear, and which at the same time avoids or at least reduces the occurrence of unavoidable laundry treatment agent spilling. Another object of the present invention relates to a laundry appliance featuring an improved drawer with an enhanced mechanical stability. A further object of the present invention relates to a laundry appliance featuring an improved drawer which provides an enhanced user experience (i.e., capable of preventing that the drawer touches the laundry appliance door).

One or more aspects of the present invention are set out in the independent claims, with advantageous features of the same invention that are indicated in the dependent claims, whose wording is enclosed herein verbatim by reference (with any advantageous feature being provided with reference to a specific aspect of the present that applies mutatis mutandis to any other aspect thereof).

An aspect of the present invention relates to a laundry appliance.

According to an embodiment of the present invention, the laundry appliance comprises a cabinet accommodating a laundry treatment chamber and a storage drawer comprising at least one compartment adapted to contain multiple doses of a respective laundry treatment agent for performing multiple washing cycles.

According to an embodiment of the present invention, the laundry appliance further comprises a drawer seat provided in the cabinet for slidingly housing the storage drawer through a guide system.

According to an embodiment of the present invention, the guide system is adapted to guide the sliding of the storage drawer with respect to the drawer seat along a sliding direction which is slanted with respect to a resting surface on which the laundry appliance is resting during operation.

According to an embodiment of the present invention, the sliding direction is slanted with respect to a cabinet top.

According to an embodiment of the present invention, the sliding direction is not perpendicular with respect to the direction of gravity force when the laundry appliance is in operation.

According to an embodiment of the present invention, said sliding direction extends downward by moving from the outside to the inside of the cabinet.

According to an embodiment of the present invention, said sliding direction has a non-null component along the gravity force direction.

According to an embodiment of the present invention, said guide system comprises at least one drawer seat guide element arranged on the drawer seat, and at least one storage drawer guide element on the storage drawer and adapted to slidingly engage with the drawer seat guide elements for allowing the storage drawer to move with respect to the drawer seat.

According to an embodiment of the present invention, said at least one drawer seat guide element and said at least one storage drawer guide element extend along said sliding direction.

According to an embodiment of the present invention, the at least one storage drawer guide element comprise rail elements located on lateral walls of the storage drawer.

According to an embodiment of the present invention, said rail elements extend substantially perpendicularly to the resting surface.

According to an embodiment of the present invention, the storage drawer comprises a storage drawer rear portion and an opposite storage drawer front portion.

According to an embodiment of the present invention, the storage drawer is configured to slide with respect to the drawer seat along the sliding direction between:

- a retracted position, in which the storage drawer is retracted inside the drawer seat, and
- an extracted position, in which the storage drawer is at least partially extracted from the drawer seat and the storage drawer front portion externally protrudes from the cabinet front.

According to an embodiment of the present invention, the storage drawer in the retracted position has the storage drawer front portion that is substantially flush with a cabinet front.

According to an embodiment of the present invention, the sliding direction is slanted with respect to a resting surface causes the storage drawer front portion to be raised with respect to the storage drawer rear portion along a vertical direction perpendicular to said resting surface (e.g., parallel to the gravity force direction when the laundry appliance is in operation).

According to an embodiment of the present invention, the cabinet comprises a cabinet front having a loading opening providing an access to the laundry treatment chamber, and a door for selectively opening/closing the loading opening.

According to an embodiment of the present invention, the storage drawer front portion of the storage drawer in the extracted position is raised with respect to the door along the vertical direction to an extent such not to hinder the opening of the door.

According to an embodiment of the present invention, said sliding direction forms an angle of 0.5°-5°, preferably 2°, with respect to the resting surface.

According to an embodiment of the present invention, said at least one compartment adapted to contain multiple doses of laundry treatment agent comprises two compartments.

According to an embodiment of the present invention, the storage drawer further comprises at least one further compartment adapted to contain a single dose of a respective laundry treatment agent for performing a single washing cycle.

According to an embodiment of the present invention, the storage drawer further comprises:

- a top portion and an opposite bottom portion, the bottom portion defining a bottom side of said at least one compartment;
- a drawer cover for covering at least partially said top portion of the storage drawer and
- at least one wave breaking wall member configured to break waves forming in the laundry treatment agent contained in the at least one compartment when the storage drawer is moved along the sliding direction.

According to an embodiment of the present invention, said at least one wave breaking wall member downwardly extending from the drawer cover into the at least one compartment toward the bottom portion.

According to an embodiment of the present invention, said at least one wave breaking wall member defines a free area between said wave breaking wall member and at least one compartment wall around the periphery of said breaking wall member.

According to an embodiment of the present invention, the at least one wave breaking wall member occludes a free area portion of the at least one compartment along a plane perpendicular to said sliding direction.

According to an embodiment of the present invention, said occluded area portion corresponds to 20%-90%, preferably 40%-60%, of the area of said at least one compartment along said plane perpendicular to said sliding direction.

According to an embodiment of the present invention, the at least one wave breaking wall member is integrally formed with the drawer cover.

According to an embodiment of the present invention, the drawer cover defines at least one access opening in fluid communication with a corresponding one of the at least one compartment for allowing laundry treatment agent to be loaded inside said at least one compartment from above.

According to an embodiment of the present invention, the at least one wave breaking wall member comprises a wave breaking wall member surrounding at least partially at least one access opening.

According to an embodiment of the present invention, the at least one wave breaking wall member comprises a substantially rectangular wave breaking wall member.

According to an embodiment of the present invention, said at least one wave breaking wall member comprises two wave breaking wall members downwardly extending from the drawer cover into a corresponding same compartment toward the bottom portion.

According to an embodiment of the present invention, said two wave breaking wall members are spaced apart from each other along a direction parallel to the sliding direction.

According to an embodiment of the present invention, said at least one wave breaking wall member comprises:

- a first wave breaking wall member downwardly extending from the drawer cover into a corresponding compartment and surrounding at least partially the access opening in fluid communication with said corresponding compartment, and
- a second wave breaking wall member downwardly extending from the drawer cover into said corresponding compartment.

DETAILED DESCRIPTION OF EXEMPLARY AND NON-LIMITATIVE EMBODIMENTS OF THE PRESENT INVENTION

Figure 1A:
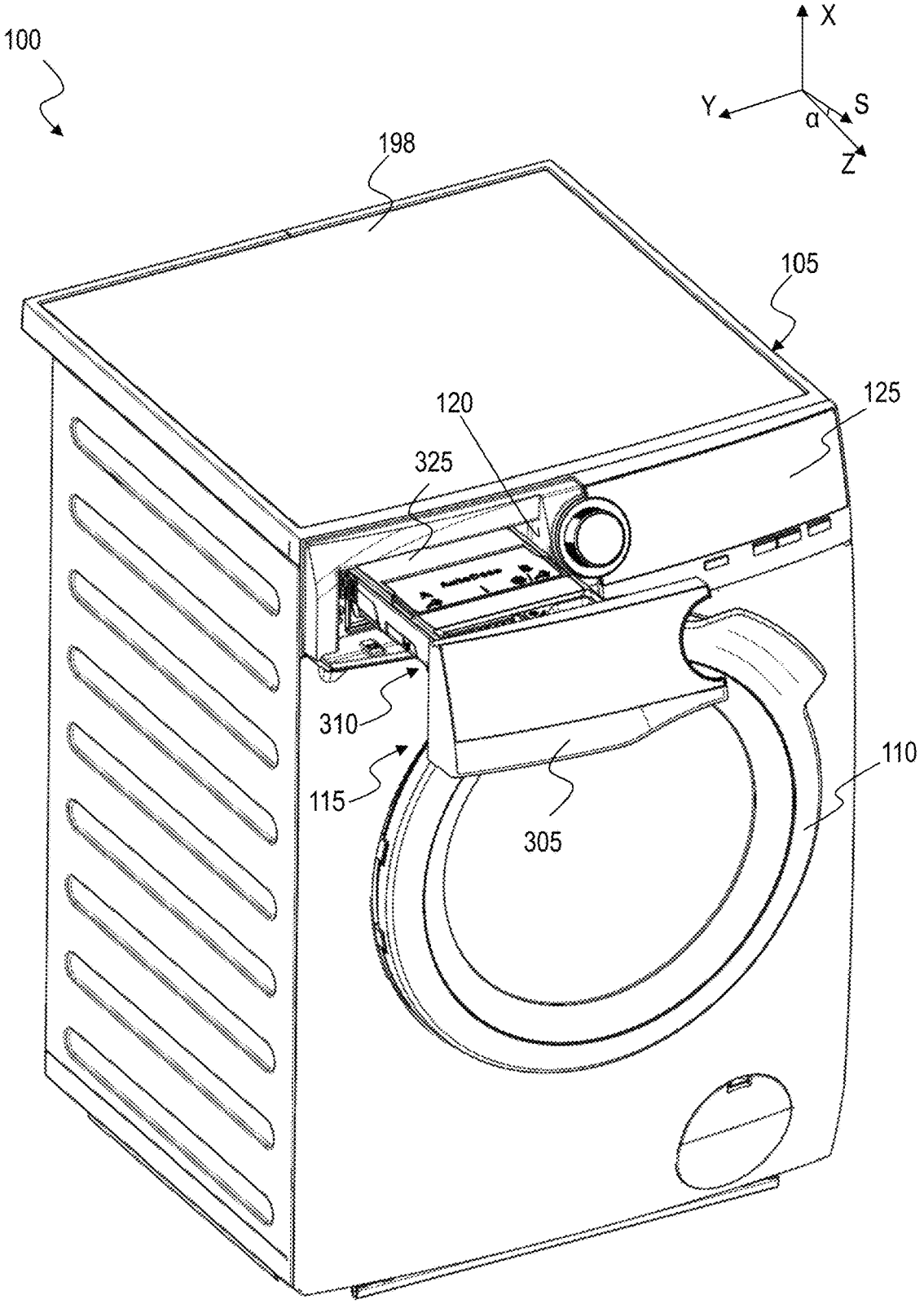
FIGS. 1A and 1B show perspective views of a laundry appliance according to an embodiment of the present invention.
Figure 1B:
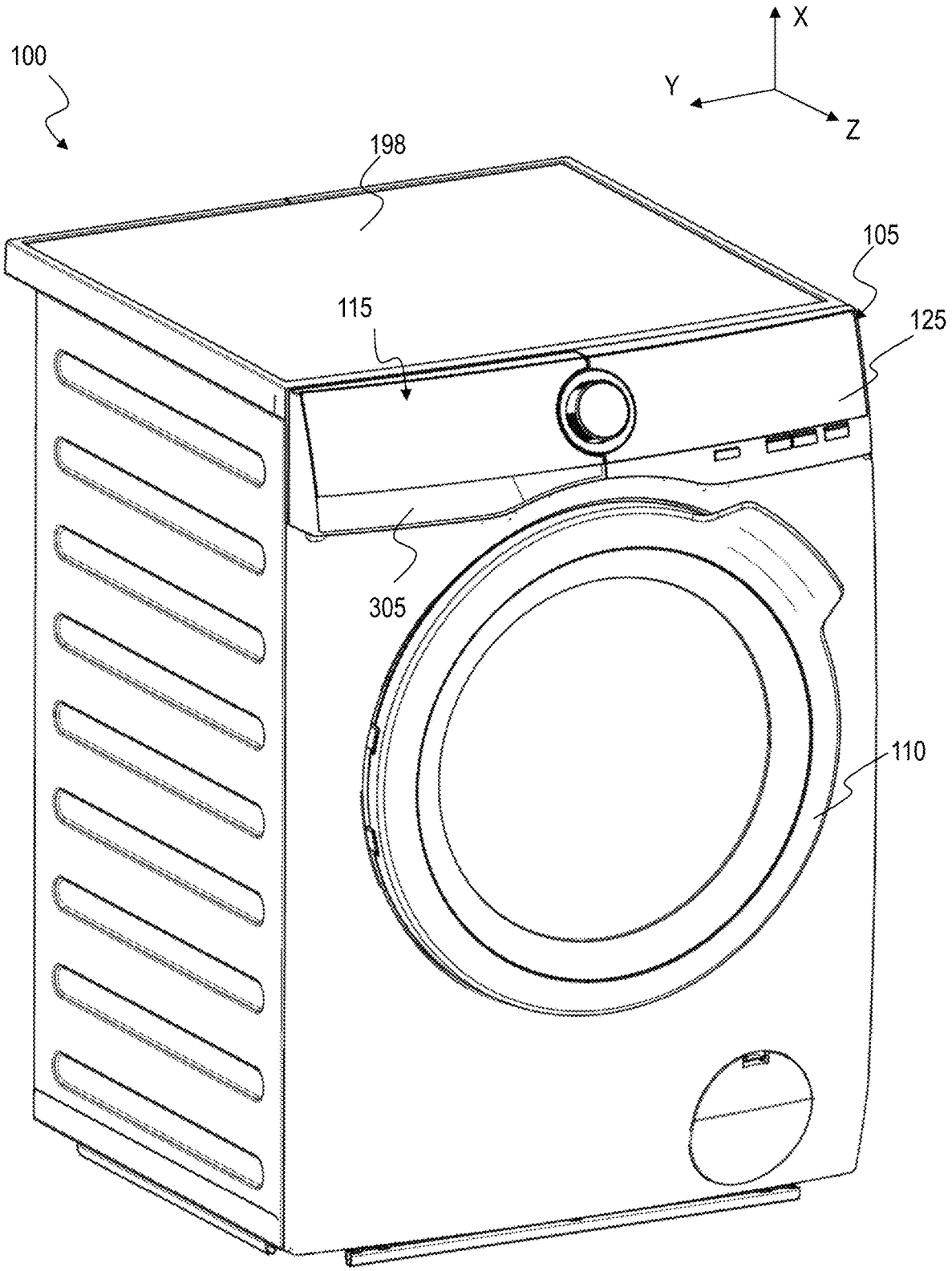

With reference to the drawings, sharing the same reference system identified by the three orthogonal directions x, y and z, FIGS. 1A and 1B show perspective views of a laundry appliance 100 according to an embodiment of the present invention.

Figure 2A:
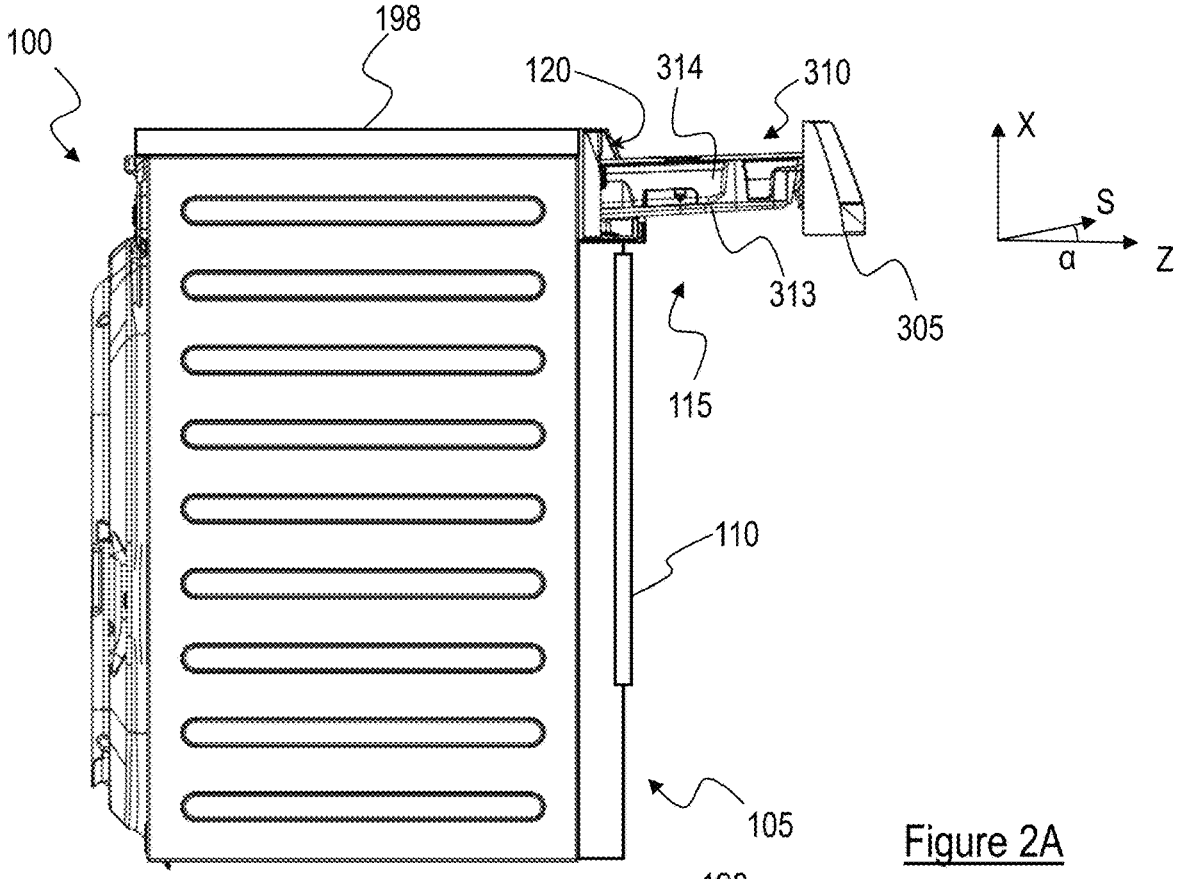
FIGS. 2A and 2B are side views of the laundry appliance of FIGS. 1A and 2B.
Figure 2B:
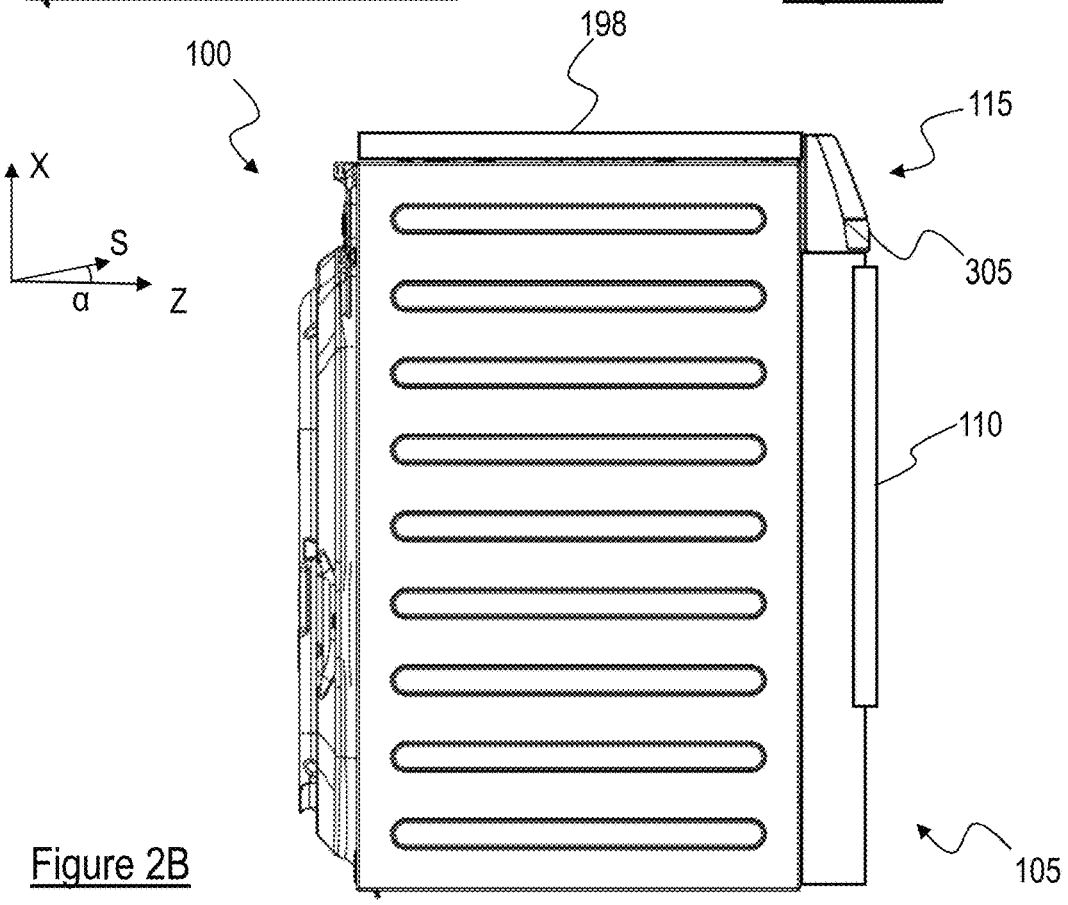

FIGS. 2A and 2B are side views (along a plane parallel to directions x and z) of the laundry appliance 100 illustrated in FIGS. 1A and 1B, respectively.

According to the exemplary, not limiting, embodiment herein considered, the laundry appliance 100 is a washing machine. In any case, although in the following description explicit reference will be made to a washing machine, this should not to be construed as a limitation; indeed, the present invention applies to other types of laundry appliances (for example combined laundry washing and drying machines, i.e., washing machines also having laundry drying functions).

The laundry appliance 100 comprises a (e.g., parallepiped-shaped) cabinet 105, which accommodates a laundry treatment chamber for performing a laundry treatment cycle on items housed therein (i.e., a washing cycle on a laundry load in the example herein considered of a washing machine).

In operation, the laundry appliance 100 rests on a resting surface, such as the floor of a room, parallel to the directions y and z, and uprightly extends from it along direction x.

The laundry treatment chamber preferably comprises a washing tub (not shown) and, within it, a (e.g., rotatable) washing basket or drum (not shown) adapted to contain the laundry load to be washed. A cabinet front has a loading opening providing an access to the drum for loading/unloading the laundry load, a door 110 (shown in a closed position in the figures) being provided for sealably closing the loading opening during the operation of the laundry appliance 100.

Although not shown, the laundry appliance 100 also comprises, enclosed in the cabinet 105, electrical/electronic/mechanical/hydraulic components for the operation of the laundry appliance 100 (such as for example motor, electromechanical valves, pumps and impellers of the hydraulic apparatus, one or more heating elements for heating water/treatment agents/air).

Figure 3A:
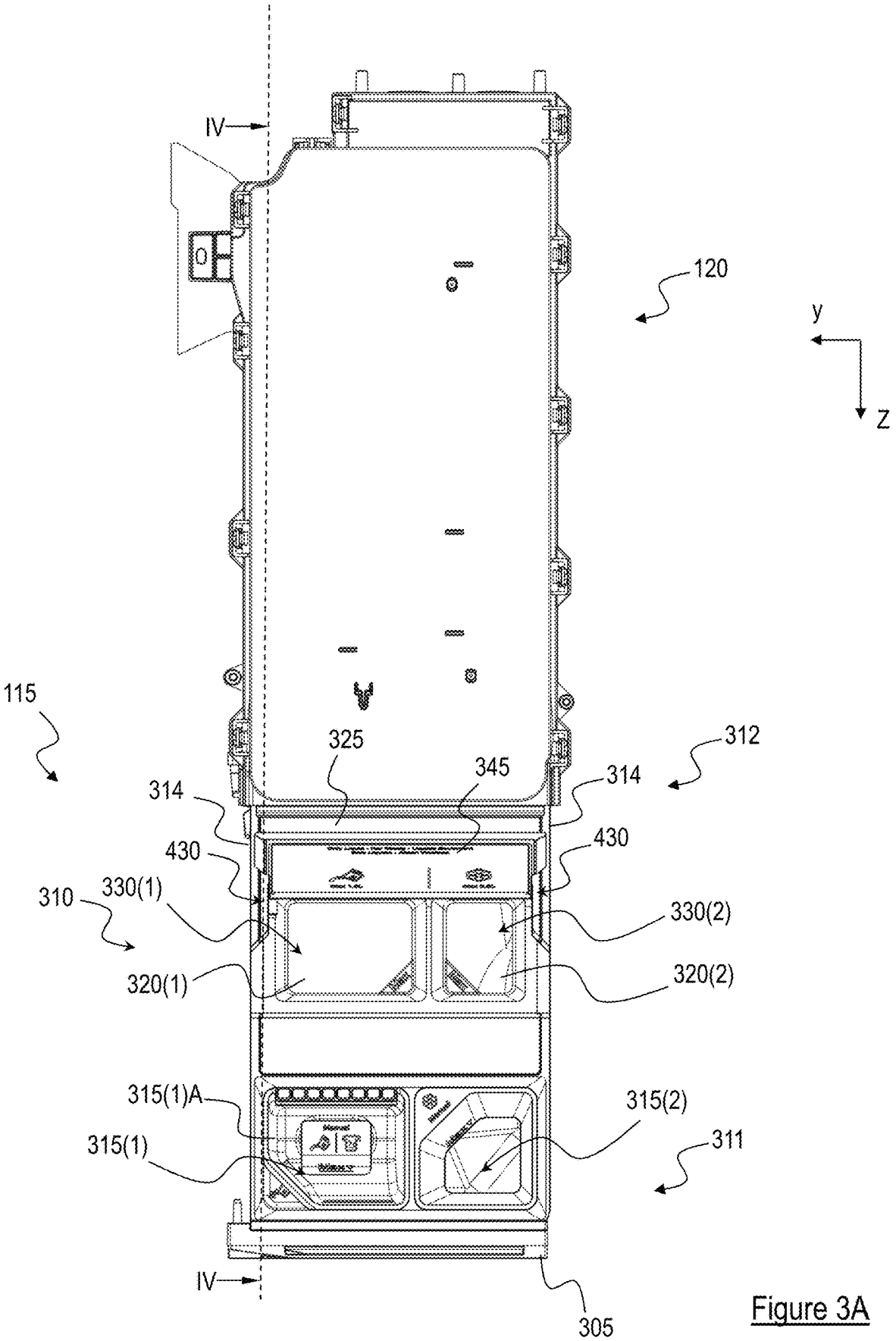
FIGS. 3A and 3B are top views of a drawer of the laundry appliance.
Figure 3B:
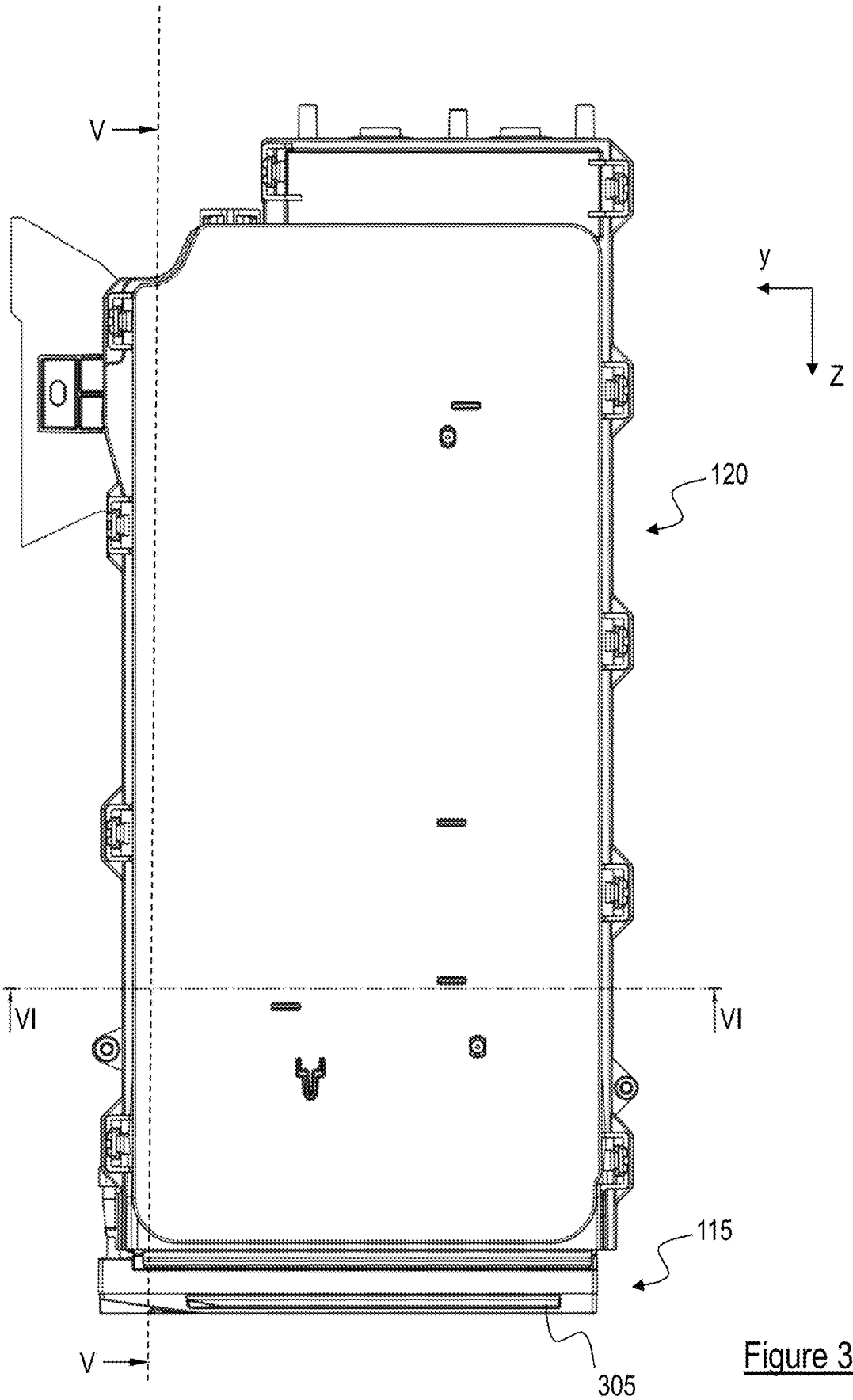

The laundry appliance 100 further comprises a storage drawer 115 (hereinafter, simply referred to as drawer) for containing one or more laundry treatment agents such as liquid and powder treatment agents including, but not limited to, washing detergents, rinsing detergents, bleaches and softeners. The laundry appliance 100 also comprises a drawer seat 120 (preferably provided on a top part of a cabinet front) for housing the drawer 115, the drawer being advantageously adapted to slide within the drawer seat 120, along a sliding direction S, between an extracted position (shown in FIGS. 1A and 2A) and a retracted position (shown in FIGS. 1B and 2B). FIG. 3A is a top view taken along a plane parallel to directions z and y of the drawer 115 and of the drawer seat 120 with the drawer in the extracted position according to an embodiment of the present invention, and FIG. 3B is the same view of the drawer 115 and drawer seat 120 of FIG. 3A but with the drawer 115 that is in the retracted position (i.e., retracted inside the drawer seat 120).

Preferably, the laundry appliance 100 further comprises a user interface 125, the user interface 125 being preferably provided on the top part of the cabinet front, more preferably next to the drawer seat 120 along direction y.

Preferably, although not necessarily, the user interface 125 comprises a display unit, not shown, for visually displaying one or more pieces of information; the display unit may for example be a light emitting polymer display (LPD), a liquid crystal display, a thin film transistor-liquid crystal display, or an organic light-emitting diode display.

The user interface 125 preferably comprises one or more control elements (e.g., selection buttons and/or knobs) for allowing the user to select a washing cycle and to control one or more operating parameters of the selected washing cycle (including, but not limited to, temperature, laundry load dirt level, spin speed, start time delay, drawer compartment selection, treatment agent selection). Additionally, as herein exemplary assumed, or alternatively, the user interface 125 preferably comprises one or more status indicators for indicating to the user a status of the laundry appliance 100; the status indicators may be configured to indicate a status of one or more components of the laundry appliances 100 and/or a status of the washing cycle (including, but not limited to, information about a residual time to the end of the ongoing washing cycle, and/or information about a current phase of the ongoing washing cycle, and/or selected parameters for the ongoing washing cycle, and/or selected drawer compartment, and/or selected treatment agent).

The drawer 115 advantageously comprises a drawer handle 305 allowing the user to slidably move the drawer 115 between the extracted position and the retracted position when it is fitted into the drawer seat 120, and a drawer body 310 to which the drawer handle 305 is adapted to be mounted (for example, in a removable or reversible way).

The drawer body 310 comprises a drawer front portion 311 and an opposite drawer rear portion 312 that, along the direction z, is rearward with respect to the drawer front portion 311. The drawer front portion 311 of the drawer body 310 preferably comprises the drawer handle 305 and is preferably arranged to be substantially flush with the cabinet front when the drawer 115 is in the retracted position, and to externally protrude from the cabinet front when the drawer 115 is in the extracted position.

The drawer body 310 comprises external walls at least partially defining the external shape of the drawer 115 portion sliding into the drawer seat 120 (and therefore into the cabinet 105). Said external walls preferably comprise a drawer bottom wall 313 (see FIG. 2A) opposite, and preferably parallel, to a top side of the drawer body 310 that preferably comprises access mouth(s) for allowing laundry treatment agent loading inside compartment(s) within the drawer body 310 from above, and two drawer lateral walls 314 connecting the drawer bottom wall 313 with the top side of the drawer. The drawer bottom wall 313 defines a bottom side of the compartments within the drawer body 310. The drawer lateral walls 314 preferably extends along a plane parallel to directions x and z, i.e., perpendicularly to the drawer bottom wall 313 and perpendicularly to the resting surface, from the drawer front portion 311 to the drawer rear portion 312 of the drawer body 310.

The drawer 115 preferably comprises two or more (two, in the example at issue) drawer compartments 320(1), 320(2) each one adapted to contain multiple doses of a respective laundry treatment agent for performing multiple washing cycles, hereinafter referred to as multi-dose compartments: therefore, the considered laundry appliance 100 is configured to implement an auto-dosing functionality in which, at each washing cycle (and when the auto-dosing functionality is enabled), a predetermined amount (dose) of laundry treatment agent is automatically taken (e.g., by means of a pump, preferably a peristaltic pump) from one or both of the multi-dose compartments 320(1), 320(2). Just as an example, the multi-dose compartment 320(1) may be arranged to contain multiple doses of a liquid washing detergent, whereas the multi-dose compartment 320(2) may be arranged to contain a multiple doses of a liquid softener. Preferably, the drawer 115 also comprises, associated with the multi-dose compartments 320(1), 320(2), two or more access openings; more preferably each access opening allows accessing a respective one of the multi-dose compartments 320(1), 320(2) for laundry treatment agent loading.

Preferably but not necessarily, the drawer body 310 further comprises one or more (two, in the example at issue) drawer compartments 315(1), 315(2) each one adapted to contain a single dose of a respective laundry treatment agent for performing a single washing cycle, hereinafter referred to as mono-dose compartments 315(1), 315(2); just as an example, the mono-dose compartment 315(1) may be arranged to contain a single dose of a powder or liquid washing detergent, whereas the mono-dose compartment 315(2) may be arranged to contain a single dose of a powder or liquid of pearl softener.

Preferably, although not necessarily, the mono-dose compartments 315(1), 315(2) are formed side by side along the direction y; more preferably, the mono-dose compartments 315(1), 315(2) are formed in an area of the drawer body 310 at the drawer front portion 311 (hereinafter referred to as front area of the drawer body 310). Preferably, herein assumed, each mono-dose compartment 315(1), 315(2) extends in depth (i.e., along direction x) from a top of the drawer body 310 that identifies a respective access mouth for allowing treatment agent loading from above.

Preferably, drawer 115 may also comprise one or more adapter components each one configured to be inserted into or removed from a respective mono-dose compartment 315(1), 315(2) for adapting it to, respectively, liquid or powder treatment agents. In the example at issue, an adapter component comprising a (for example, cup-shaped) container 315(1)A is configured to be reversibly housed into the mono-dose compartment 315(1).

Preferably, although not necessarily, the multi-dose compartments 320(1), 320(2) are formed side by side along the direction y. More preferably, the multi-dose compartments 320(1), 320(2) are formed in an area of the drawer body 310 (hereinafter referred to as rear area of the drawer body 310) that, along the direction z, is rearward with respect to the front area of the drawer body 310 (i.e., the area of the drawer body 310 where the mono-dose compartments 315(1), 315(2) are provided). Even more preferably, as visible in the figures, the front and rear areas of the drawer body 310 are properly different in size, and particularly the rear area of the drawer body 310 is larger (along direction z) than the front area of the drawer body 310 (e.g., the rear area of the drawer body 310 being for example from 2 to 4 times larger than the front area of the drawer body 310); when, as herein exemplary considered, same extensions in depth (along direction x) of the mono-dose 315(1), 315(2) and multi-dose 320(1), 320(2) compartments are assumed, having the rear area of the drawer body 310 larger (along direction z) than the front area of the drawer body 310 translates into correspondingly different capacities of the mono-dose 315(1), 315(2) and multi-dose 320(1), 320(2) compartments (with the multi-dose compartments 320(1), 320(2) that are sized to store larger amounts of treatment agent as compared to the mono-dose compartments 315(1), 315(2)).

Preferably, the drawer 115 also comprises a (top) drawer cover 325 for covering the top side of the drawer body 310. More preferably, the drawer cover 325 is configured to cover the rear area of the drawer body 310, thus leaving uncovered the front area of the drawer body 310, and hence the mono-dose compartments 315(1), 315(2); the mono-dose compartments 315(1), 315(2) can therefore be directly accessed from above (i.e., through the respective access mouths) for loading the treatment agents therein. Even more preferably, the drawer cover 325 comprises the above mentioned access openings associated (and in fluid communication) with the multi-dose compartment 320(1), 320(2) for loading the treatment agent; in the example at issue in which the drawer body 310 comprises two multi-dose compartments 320(1), 320(2), two access openings 330(1), 320(2) are provided in the drawer cover 325.

According to another embodiment of the invention not illustrated in the figures, the drawer cover 335 may be configured to cover also the front area of the drawer body 310; in this case, the drawer cover 325 may comprise access openings associated with the mono-dose compartment 315(1), 315(2) for loading the treatment agent; in the example at issue in which the drawer body 310 comprises two mono-dose compartments 315(1), 315(2), two access openings may be provided in the drawer cover 325.

Preferably, although not necessarily, the access openings 330(1), 330(2) are formed in the drawer cover 325 side by side along direction y.

The drawer 115 preferably comprises an access component associated for selectively covering and uncovering the access openings 330(1), 330(2) thereby respectively preventing and allowing access to the respective multi-dose compartments 320(1), 320(2) (in the exemplary considered embodiment, no access components are provided for selectively covering and uncovering the access mouths of the mono-dose compartments 315(1), 315(2), however this should not be construed as a limitation).

The access component may for example be a door 345, the door being advantageously coupled or coupleable to the drawer cover 325 at the respective access openings 330(1), 330(2). According to the advantageous embodiment herein considered and illustrated, the door 345 is a single flap door pivotally coupled to the drawer cover 325 so as to be actuatable by the user between an open position (shown in of FIG. 3A) and a closed position (shown in FIGS. 1A and 2A) for jointly uncovering and covering, respectively, both the access openings 330(1), 330(2). In order to allow the drawer 115 to slide inside the drawer seat 120 in the retracted position (see FIGS. 1B and 3B), the door 345 should be in the closed position. The concepts of the present invention directly apply if the access component comprises two separate doors each one actuatable for uncovering and covering a respective one of the access openings 330(1), 330(2).

According to an embodiment of the present invention, a guide system for the drawer 115 is provided, which is arranged for causing the sliding direction S of the drawer 115 within the drawer seat 120 to be slanted with respect to the resting surface on which the laundry appliance 100 rests during operation (i.e., slanted with respect to a cabinet top 198). From a different point of view, according to an embodiment of the present invention, the sliding direction has a non-null component along the gravity force direction when the laundry appliance 100 is in operation.

The guide system according to embodiments of the present invention is configured in such a way that the sliding direction S extends downward by moving from the outside to the inside of the casing 105.

In other words, during the movement of the drawer 115 from the retracted position to the extracted position, the drawer 115 increases its distance (along direction x) from the resting surface, while during the movement of the drawer 115 from the extracted position to the retracted position, the drawer 115 decreases its distance (along direction x) from the resting surface.

Figure 4:
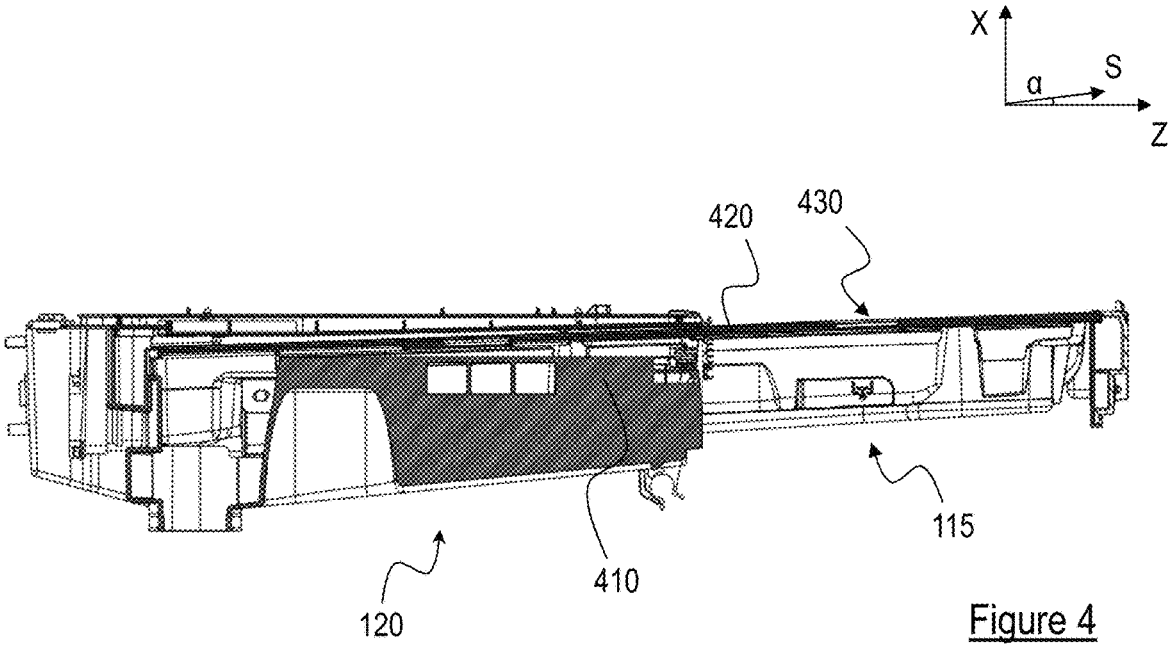
FIGS. 4 and 5 are cross section views of the drawer of FIGS. 3A and 3B, respectively, according to an embodiment of the present invention.
Figure 5:
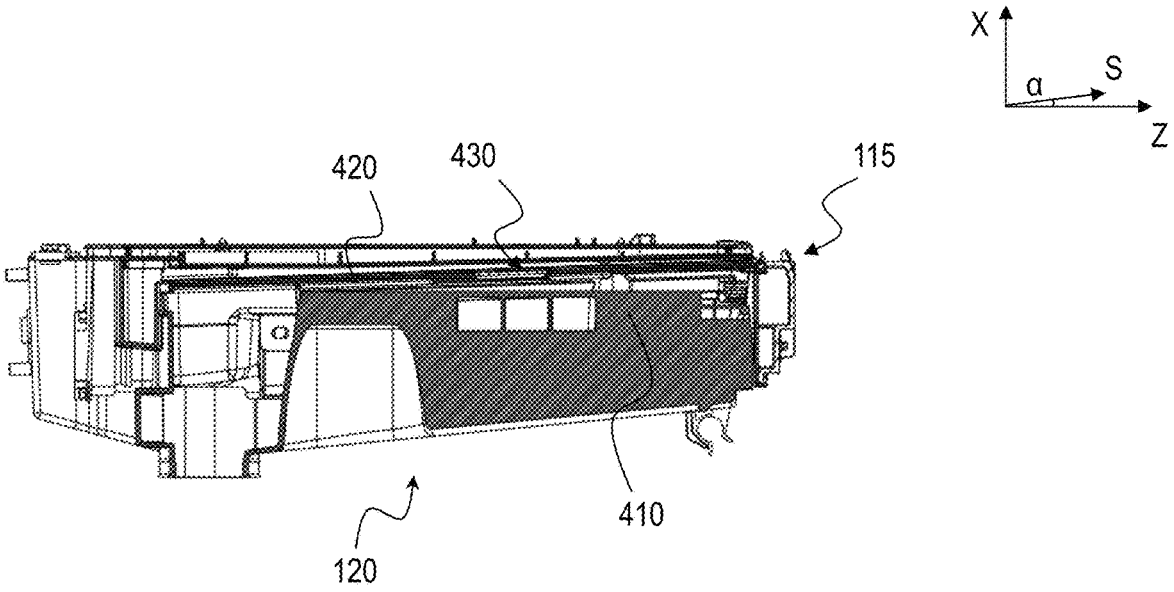
Figure 6:
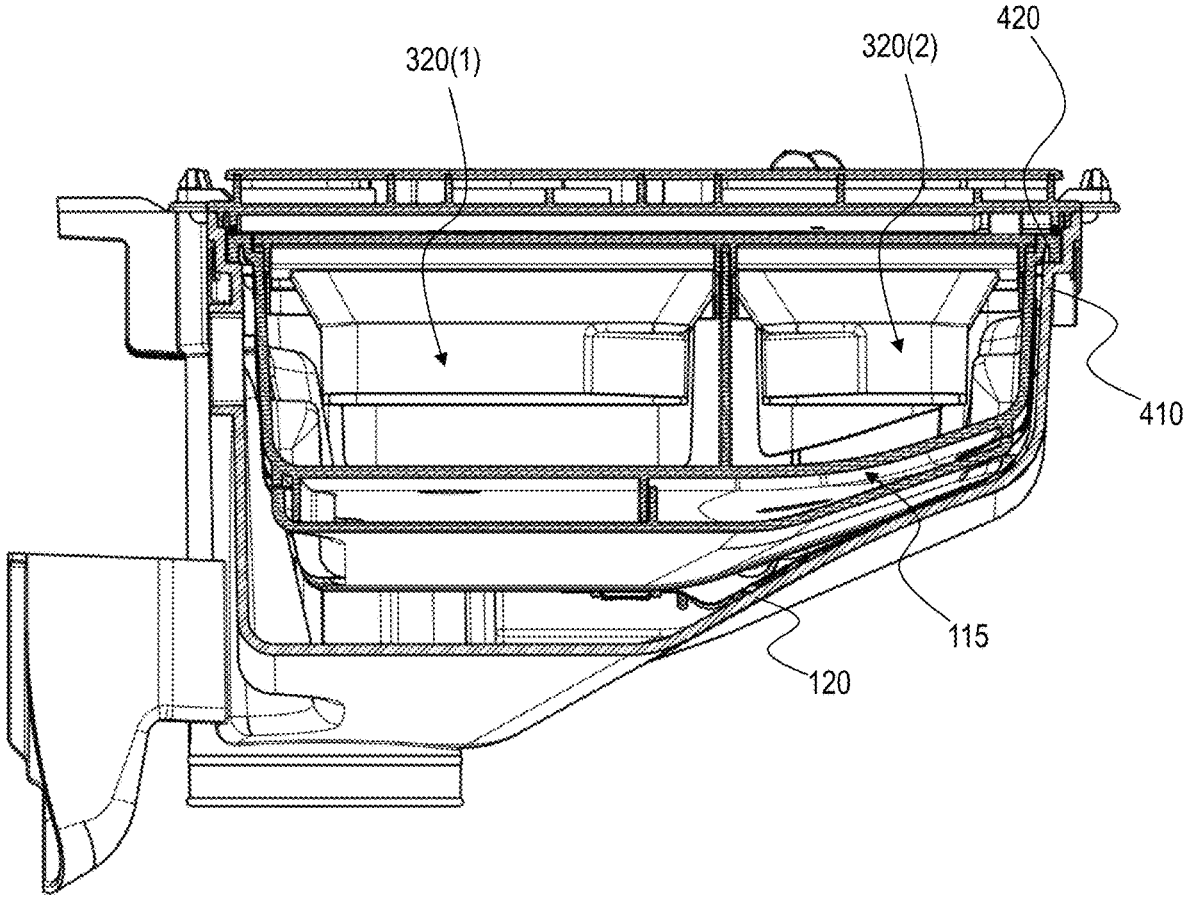
FIG. 6 is a further cross section view of the drawer of FIG. 3B according to an embodiment of the present invention.

In order to illustrate how the guide system for the drawer 115 is structured according to embodiments of the present invention, reference will be now made to FIGS. 4, 5, and 6. FIG. 4 is a cross section view of the drawer 115 taken along a section plane parallel to directions x and z and passing through line IV-IV depicted in FIG. 3A (but with the door 345 that is in the closed position). FIG. 5 is a cross section view of the drawer 115 taken along a section plane parallel to directions x and z and passing through line V-V depicted in FIG. 3B, In FIG. 4, the drawer 115 is in the extracted position (i.e., at least partially extracted from the drawer seat 120), while in FIG. 5, the drawer 115 is in the retracted position (i.e., retracted inside the drawer seat 120). FIG. 6 is a cross section view of the drawer (in the retracted position) taken along a section plane parallel to directions x and y and passing through line VI-VI depicted in FIG. 3B.

According to an embodiment of the present invention, the guide system comprises at least one drawer seat guide element 410 arranged on the drawer seat 120 and at least one drawer guide element 420 arranged on the drawer 115.

According to an embodiment of the present invention, each one of said at least one drawer guide element 420 is configured to slidingly engage a corresponding one of said at least one drawer seat guide element 410 for allowing the drawer 115 to move by sliding with respect to the drawer seat 120.

According to an embodiment of the present invention, the guide system is arranged in such a way that the at least one drawer seat guide element 410 extend along the sliding direction S (which is slanted with respect to the resting surface). According to an embodiment of the present invention, the at least one drawer seat guide element 410 comprises two drawer seat guide elements 410 (e.g., rail members) extending along the sliding direction S on the internal side of lateral walls of the drawer seat 120 (i.e. walls of the drawer seat 120 parallel to directions x and z). It has to be appreciated that by "internal side" of a lateral wall of the drawer seat 120 it is intended the side of such lateral wall that faces the drawer 115 when the latter is housed in the drawer seat 120.

According to an embodiment of the present invention, the at least one drawer guide element 420 comprises two drawer guide elements 420 (e.g., rail members) each one located on the external side of one of the two drawer lateral walls 314. It has to be appreciated that by "external side" of a drawer lateral wall 314 it is intended the side of such lateral wall which is pointed towards the outside of the drawer body 310 (i.e., toward the internal side of lateral walls of the drawer seat 120 when said drawer 115 is in the retracted position).

According to an embodiment of the present invention, each drawer guide element 420 located on a drawer lateral wall 314 is arranged to slidingly engage the drawer seat guide element 410 which is located on the lateral wall of the drawer seat 120 facing said drawer lateral wall 314.

In the embodiment of the invention illustrated in the figures, each drawer seat guide element 410 provides a continuous sliding surface—for slidingly engaging a corresponding drawer guide element 420—which extends along the sliding direction S on a lateral wall of the drawer seat 120 without exhibiting any interruption. Instead, in the embodiment of the invention illustrated in the figures, each drawer guide element 420 is discontinuous, and comprises two separated guide sub-elements which are spaced apart to each other by a gap, identified in figures with reference 430, located at the door 345 coupled to the drawer cover 325, in order to provide a grip space for facilitating the opening/closing operations of the door 345 by a user. In any case, the concepts of the present invention apply also in case the drawer guide elements 420 comprise a different number of guide sub-elements, or in case the drawer guide elements 420 are continuous guide elements, and/or in case the drawer seat guide elements 410 are discontinuous guide elements (comprising two or more separated guide sub-elements).

Since the drawer seat guide element 410 extends along the sliding direction S, when the drawer 115 is inserted into the drawer seat 120, with the drawer guide elements 420 that engages the drawer seat guide elements 410, the drawer 115 is restricted to move (slide) itself with respect to the drawer seat 120 along the sliding direction S, too.

Even if reference has been explicitly made only to the case in which the at least one drawer seat guide element 410 comprises two drawer seat guide elements 410 on lateral walls of the drawer seat 120, and the at least one drawer guide element 420 comprises two drawer guide elements 420 located on the drawer lateral walls 314, similar considerations apply if a different number of guide elements are provided, such as for example in case two drawer seat guide elements 410 are provided for each lateral wall of the drawer seat 120, and two drawer guide elements 420 are provided for each drawer lateral wall 314, and/or in case at least one drawer guide element 420 is provided on the external side of the drawer bottom wall 313 and adapted to slidingly engage at least one drawer seat guide element provided on a bottom wall of the drawer seat 120.

According to an embodiment of the present invention, the sliding direction S may form an angle $\alpha$ of 0.5° to 5°, preferably 2°, with respect to the resting surface.

Thanks to the slanted sliding direction S imposed by the guide system according to the embodiments of the present invention, the drawer body 310 has the drawer front portion 311 that is raised with respect to the drawer rear portion 312 along a direction perpendicular to the resting surface (i.e., along x direction).

This feature is particularly advantageous since it strongly improves the mechanical stability of the drawer 115 when the latter is in the extracted position even if the drawer 115 is particularly heavy (i.e., when the multi-dose compartments 320(1), 320(2) contain a large amount of laundry treatment agent). Having an improved mechanical stability, the guide system according to the embodiments of the present invention is advantageously less subjected to wear and is capable of avoiding (or at least reducing) downward bending of the drawer 115 when the latter is in the extracted position. This advantageously reduces in turn the occurrences of undesired laundry treatment agent spilling.

Moreover, having the drawer front portion 311 that is raised with respect to the drawer rear portion 312 along x direction, the portion of the drawer 115 which protrudes from the cabinet front of the drawer 115 in the extracted position is advantageously raised (along direction x) with respect to the door 100 (see FIG. 2A). In this way, the possibility that the extracted drawer 115 disadvantageously touches a part of the door 110 is avoided, allowing a free opening/closing movement of the door 110 when the drawer 115 is in the extracted position.

According to an embodiment of the present invention, a wave breaking system is provided, which is configured to break waves which can be formed at the free surface of the laundry treatment agent contained in at least one of the multi-dose compartments 320(1), 320(2) when the storage drawer 115 is moved along the sliding direction S between the extracted and retracted positions because of the accelerations the drawer 115 is subjected to during such movements.

According to an embodiment of the present invention, such wave breaking system comprises at least one wave breaking wall member associated with the drawer cover 325 and downwardly extending from the drawer cover 325 into a respective multi-dose compartments 320(1), 320(2) toward the drawer bottom wall 313.

Figure 7:
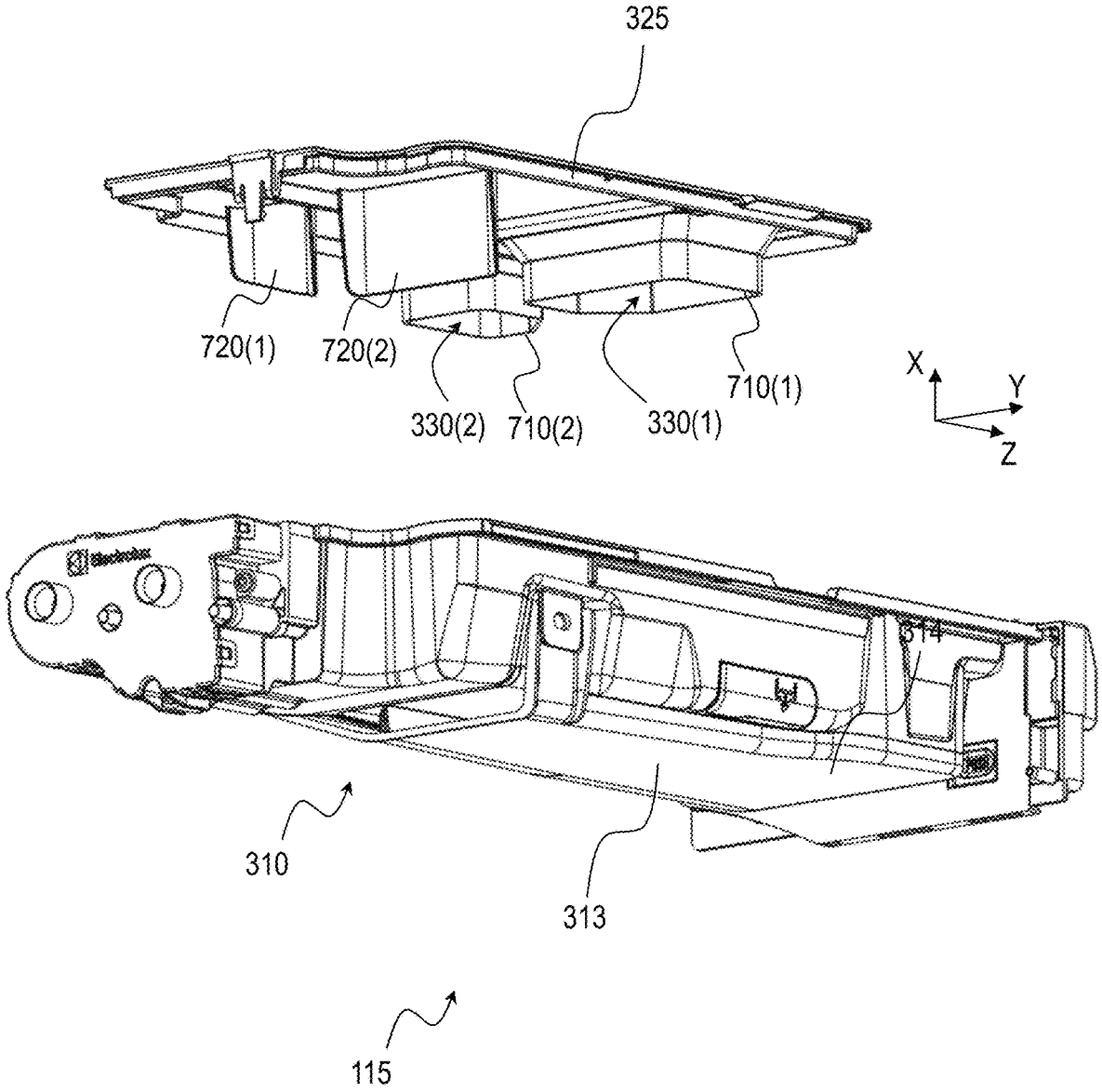
FIG. 7 is a perspective view of the drawer of the laundry appliance with a drawer cover detached and partially displaced from a drawer body according to an embodiment of the present invention.
Figure 8:
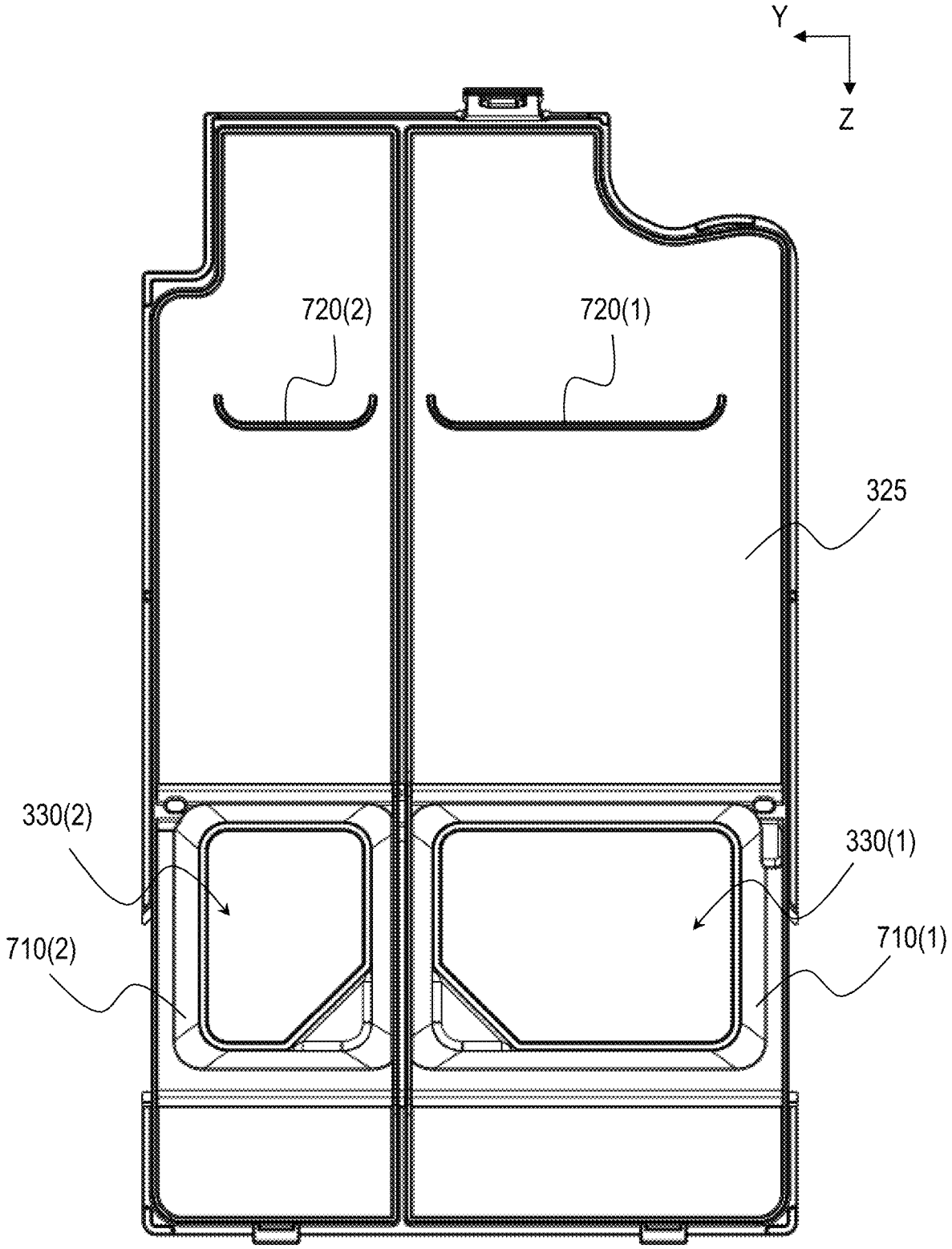
FIG. 8 is a plan view of the bottom side of the drawer cover according to an embodiment of the present invention.
Figure 9:
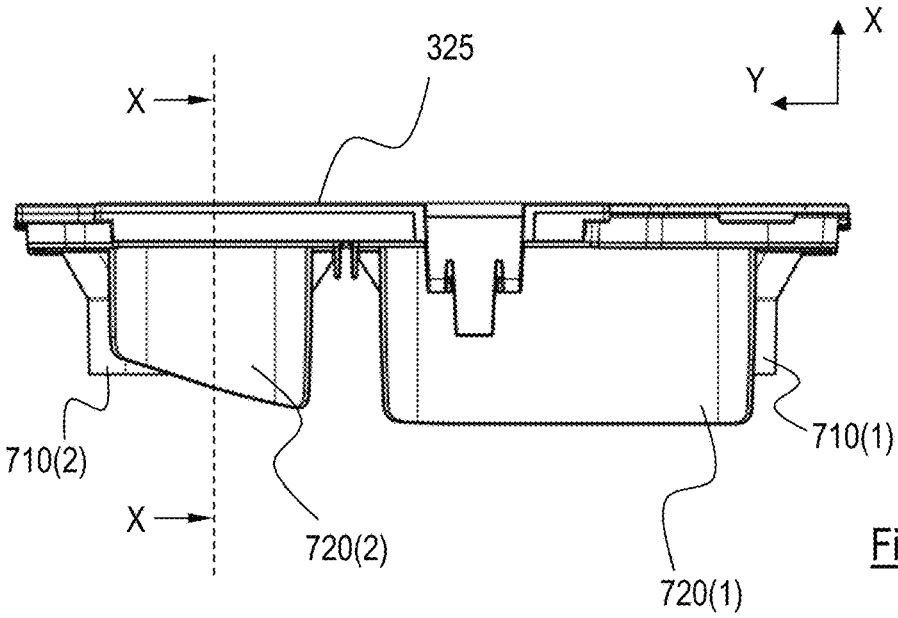
FIG. 9 is a rear view of the drawer cover of FIG. 8.
Figure 10:
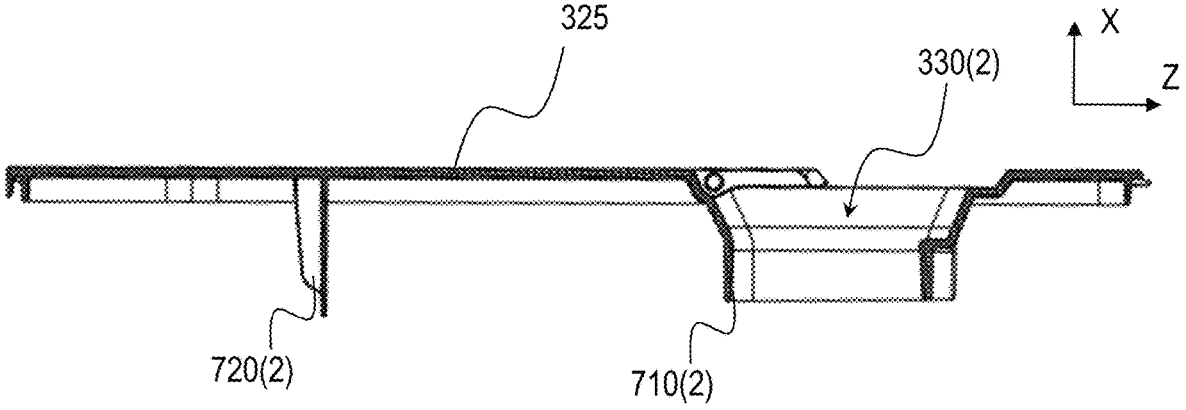
FIG. 10 is a section view of the drawer cover of FIGS. 8 and 9.

In order to illustrate how the wave breaking system for the drawer 115 is structured according to embodiments of the present invention, reference will be now made to FIGS. 7-10. FIG. 7 is a perspective view of the drawer 115 (entirely removed from the drawer seat 120) with the drawer cover 325 detached and partially displaced from the drawer body 310. FIG. 8 is a plan view of the bottom side of the drawer cover 325 (i.e., the side thereof facing toward the drawer body 310) taken from a plan parallel to directions y and z. FIG. 9 is a rear view of the drawer cover 325 taken from a plan parallel to directions x and y, and FIG. 10 is a section view of the drawer cover 325 taken along a section plane parallel to directions x and z and passing through line X-X of FIG. 9.

According to a preferred embodiment of the invention, the wave breaking system comprises two wave breaking wall members 710(1), 710(2), each one comprising a wall which downwardly protrudes from the inner side of the drawer cover 325 and surrounds from below a respective one between the two access openings 330(1), 330(2) provided on the drawer cover 325. In the considered example, where the access openings 330(1), 330(2) are substantially rectangle-shaped, each breaking wall member 710(1), 710(2) has the shape of a rectangular tube. However, similar considerations apply in case the breaking wall members 710(1), 710(2) have different shapes. For example, according to an alternative embodiment of the invention not illustrated in the figures, each breaking wall member 710(1), 710(2) may only partially encircle the two access openings 330(1), 330(2).

According to an embodiment of the invention, in addition to, or in place of the wave breaking wall members 710(1), 710(2), the wave breaking system comprises two wave breaking wall members 720(1), 720(2) each one comprising a wall substantially extending along direction y and which downwardly protrudes from a portion of the inner side of the drawer cover 325 which is rearward with respect to the access openings 330(1), 330(2).

In the embodiment of the invention illustrated in the figures, the wave breaking system comprises the two wave breaking wall members 710(1), 710(2) and at the same time the two wave breaking wall members 720(1), 720(2).

Naturally, similar considerations apply if the wave breaking system comprises a different number of wave breaking wall members.

According to an embodiment of the present invention, each one of the wave breaking wall members 710(1), 710(2), 720(1), 720(2) exhibits at least one breaking surface which is arranged to oppose itself against the propagation direction of waves which could be formed at the surface of the laundry treatment agent contained in the multi-dose compartments 320(1), 320(2) when the storage drawer 115 is moved between the extracted position and the retracted position. For example, according to an embodiment of the invention, such breaking surface may extend substantially perpendicularly to the sliding direction S or may extend substantially perpendicular to direction z.

Making reference to the example illustrated in the figures, wherein each one of the wave breaking wall members 710(1), 710(2) has the shape of a rectangular tube, the breaking surfaces of the wave breaking wall members 710(1), 710(2) are the faces of the wave breaking wall members 710(1), 710(2) that extend substantially parallel to the direction y. Moreover, in the considered example, wherein each one of the wave breaking wall members 720(1), 720(2) is a wall that extends along direction y, the breaking surfaces thereof substantially correspond to the breaking wall members 720(1), 720(2) themselves. Naturally, similar considerations apply if the wave breaking wall members 710(1), 710(2), 720(1), 720(2) have different shapes, provided that each one comprises at least one breaking surface capable of oppose itself against the propagation direction of waves which could be formed at the surface of the laundry treatment agent contained in the multi-dose compartments 320(1), 320(2) when the storage drawer 115 is moved.

According to an embodiment of the present invention, each one of the wave breaking wall members 710(1), 720(1) defines a free area between said wave breaking wall member 710(1), 720(1) and one of the walls of the multi-dose compartment 320(1) around the periphery of the wave breaking wall member 710(1), 720(1). In this way, a gap is left for allowing the laundry treatment agent contained in the multi-dose compartment 320(1) to flow past and around the wave breaking wall members 710(1), 720(1). In the considered example, both the wave breaking wall member 710(1) and the wave breaking wall member 720(1) have such a length that they do not reach the drawer bottom wall 313 and/or such a width that they do not reach the lateral walls of the multi-dose compartment 320(1).

In the same way, each one of the wave breaking wall members 710(2), 720(2) defines a free area between said wave breaking wall member 710(2), 720(2) and one of the walls of the multi-dose compartment 320(2) around the periphery of the wave breaking wall member 710(2), 720(2). In this way, a gap is left for allowing the laundry treatment agent contained in the multi-dose compartment 320(2) to flow past and around the wave breaking wall members 710(2), 720(2). In the considered example, both the wave breaking wall member 710(2) and the wave breaking wall member 720(2) have such a length that they do not reach the drawer bottom wall 313 and/or such a width that they do not reach the lateral walls of the multi-dose compartment 320(2).

According to an embodiment of the present invention, each one of the wave breaking wall members 710(1), 710(2), 720(1), 720(2) is arranged to occlude with the breaking surfaces thereof a free area portion of the corresponding multi-dose compartment 320(1), 320(2) along a plane perpendicular to the sliding direction S. According to an embodiment of the present invention, such area portion of the corresponding multi-dose compartments 320(1), 320(2) occluded by the wave breaking wall members 710(1), 710(2), 720(1), 720(2) may correspond to 20%-90%, preferably 40%-60%, of the total area of the compartments along said plane perpendicular to the sliding direction S.

According to an embodiment of the present invention, the wave breaking wall members 710(1), 710(2), 720(1), 720(2) are integrally formed with the drawer cover 325, for example by using a same mold for manufacturing the former together with the latter.

According to another embodiment of the present invention, some of, or all the wave breaking wall members 710(1), 710(2), 720(1), 720(2) are instead coupled, connected or fastened to the drawer cover 325 by means of proper connection means, such as snap-fit engagements, pins, screws, and so on.

Thanks to the provision of the wave breaking system according to the embodiments of the invention previously described, the spilling of laundry treatment agent caused by the movement of the drawer 115 between the extracted and retracted positions is advantageously strongly reduced.

The present invention has been here described in detail making reference to some possible embodiments thereof. Other embodiments are possible and at the reach of the person skilled in the art.

The invention claimed is:

1. A laundry appliance, comprising:

a cabinet accommodating a laundry treatment chamber;

a storage drawer comprising at least one first compartment configured to contain multiple doses of a respective laundry treatment agent for performing multiple washing cycles and a second compartment configured to contain a respective laundry treatment agent;

a drawer seat provided in the cabinet and configured to receive the storage drawer; and a guide system configured to guide a sliding movement of the storage drawer with respect to the drawer seat along a sliding direction, the sliding direction being slanted with respect to a resting surface on which the laundry appliance is configured to rest during operation;

wherein at least one of said at least one first compartments is located directly adjacent to said second compartment along the sliding direction.

2. The laundry appliance of claim 1, wherein said sliding direction extends downward in a direction extending from an outside of the cabinet to an inside of the cabinet.

3. The laundry appliance of claim 1, wherein said guide system comprises:

at least one drawer seat guide element arranged on the drawer seat, and at least one storage drawer guide element on the storage drawer and configured to slidingly engage with the at least one drawer seat guide element to allow the storage drawer to move with respect to the drawer seat, wherein:

said at least one drawer seat guide element and said at least one storage drawer guide element extend along said sliding direction.

4. The laundry appliance of claim 3, wherein the at least one storage drawer guide element comprises rail elements located on lateral walls of the storage drawer, said rail elements extending substantially perpendicularly to the resting surface.

5. The laundry appliance of claim 1, wherein the storage drawer comprises a storage drawer rear portion and an opposite storage drawer front portion, the storage drawer being configured to slide with respect to the drawer seat along the sliding direction between:

a retracted position, in which the storage drawer is retracted inside the drawer seat, and an extracted position, in which the storage drawer is at least partially extracted from the drawer seat and the storage drawer front portion externally protrudes from the cabinet front, wherein:

the sliding direction which is slanted with respect to a resting surface causes the storage drawer front portion to be raised with respect to the storage drawer rear portion along a vertical direction perpendicular to said resting surface.

6. The laundry appliance of claim 5, wherein:

the cabinet comprises a cabinet front having a loading opening providing an access to the laundry treatment chamber, and a door movable through a door travel path for selectively opening/closing the loading opening, and the storage drawer front portion of the storage drawer in the extracted position is raised with respect to the door along the vertical direction to a position that does not intersect the door travel path.

7. The laundry appliance of claim 1, wherein said sliding direction forms an angle of 0.5 degrees to 5 degrees with respect to the resting surface.

8. The laundry appliance of claim 1, wherein the storage drawer further comprises:

a top portion and an opposite bottom portion, the bottom portion defining a bottom side of said at least one first compartment;

a drawer cover configured to at least partially cover said top portion of the storage drawer; and at least one wave breaking wall member configured to break waves forming in the laundry treatment agent contained in the at least one first compartment when the storage drawer is moved along the sliding direction, said at least one wave breaking wall member extending downwardly from the drawer cover into the at least one first compartment toward the bottom portion, said at least one wave breaking wall member defining a free area between said wave breaking wall member and at least one wall of the at least one first compartment around the periphery of said at least one wave breaking wall member.

9. The laundry appliance of claim 8, wherein the at least one wave breaking wall member occludes a free area portion of the at least one first compartment along a plane perpendicular to said sliding direction, said occluded area portion corresponding to 20%-90% of a total area of said at least one first compartment along said plane perpendicular to said sliding direction.

10. The laundry appliance of claim 9, wherein the drawer cover defines at least one access opening in fluid communication with a corresponding one of the at least one first compartments, and configured to allow laundry treatment agent to be loaded inside said at least one first compartment from above.

11. The laundry appliance of claim 10, wherein the at least one wave breaking wall member comprises a wave breaking wall member surrounding at least partially at least one access opening.

12. The laundry appliance of claim 8, wherein said at least one wave breaking wall member comprises two wave breaking wall members extending downwardly from the drawer cover into a corresponding same first compartment toward the bottom portion.

13. The laundry appliance of claim 12, wherein said two wave breaking wall members are spaced apart from each other along a direction parallel to the sliding direction.

14. The laundry appliance of claim 10, wherein said at least one wave breaking wall member comprises:

a first wave breaking wall member downwardly extending from the drawer cover into a corresponding first compartment and surrounding at least partially the access opening in fluid communication with said corresponding first compartment, and a second wave breaking wall member downwardly extending from the drawer cover into said corresponding first compartment.

15. The laundry appliance of claim 1, wherein said sliding direction forms an angle of 2 degrees with respect to the resting surface.

16. The laundry appliance of claim 8, wherein the at least one wave breaking wall member occludes a free area portion of the at least one compartment along a plane perpendicular to said sliding direction, said occluded area portion corresponding to 40%-60% of a total area of said at least one first compartment along said plane perpendicular to said sliding direction.

17. The laundry appliance of claim 4, wherein at least one of the rail elements comprises at least two guide sub-elements spaced apart along the sliding direction by a gap.

18. The laundry appliance of claim 1, wherein the storage drawer comprises an upper surface that is slanted along the sliding direction.

19. The laundry appliance of claim 4, wherein the storage drawer comprises an upper surface that is slanted along the sliding direction and wherein the upper surface is defined by upper edges of the rail elements.

* * * * *